US009950821B2

(12) United States Patent
Smith

(10) Patent No.: US 9,950,821 B2
(45) **Date of Patent: *Apr. 24, 2018**

(54) COMPONENTS FOR AEROSOL DISPENSER

(71) Applicant: The Procter & Gamble Company, Cincinnati, OH (US)

(72) Inventor: Scott Edward Smith, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 37 days.

This patent is subject to a terminal disclaimer.

(21) Appl. No.: 15/057,196

(22) Filed: Mar. 1, 2016

(65) Prior Publication Data

US 2016/0176619 A1 Jun. 23, 2016

Related U.S. Application Data

(60) Continuation of application No. 14/736,296, filed on Jun. 11, 2015, which is a division of application No.

(Continued)

(51) Int. Cl.

| | |
|---|---|
| ***B65B 31/00*** | (2006.01) |
| ***B65D 83/62*** | (2006.01) |
| ***B65D 83/38*** | (2006.01) |
| ***B65D 83/42*** | (2006.01) |
| ***B65B 31/02*** | (2006.01) |
| ***B65B 3/04*** | (2006.01) |
| *B65D 77/06* | (2006.01) |
| *B65D 83/00* | (2006.01) |
| *B65D 35/22* | (2006.01) |

(Continued)

(52) U.S. Cl.

CPC ..... *B65B 31/003* (2013.01); *B65B 3/045* (2013.01); *B65B 31/025* (2013.01); *B65D 83/38* (2013.01); *B65D 83/425* (2013.01); *B65D 83/62* (2013.01); *B05B 9/0838* (2013.01); *B65B 61/26* (2013.01); *B65D 35/22* (2013.01); *B65D 77/065* (2013.01); *B65D 83/0005* (2013.01)

(58) Field of Classification Search

CPC ..... B65D 83/62; B65D 11/00; B65B 31/003

USPC ..... 141/3, 103, 20, 25; 222/95, 105

See application file for complete search history.

(56) References Cited

U.S. PATENT DOCUMENTS

| | | | |
|---|---|---|---|
| 511,971 | A | 1/1894 | Winer |
| 3,403,804 | A | 10/1968 | Colombo |

(Continued)

FOREIGN PATENT DOCUMENTS

| | | | |
|---|---|---|---|
| EP | 0494004 | B1 | 7/1995 |
| WO | WO 02/062678 | A1 | 8/2002 |

OTHER PUBLICATIONS

U.S. Appl. No. 13/108,198, filed May 16, 2011, Smith, et al.

(Continued)

*Primary Examiner* — Timothy L Maust
*Assistant Examiner* — Timothy P Kelly
(74) *Attorney, Agent, or Firm* — Larry L. Huston

(57) ABSTRACT

A pressurized container usable for an aerosol dispenser. The container is charged with propellant. The container may be conveniently shipped, for later product filling and/or decoration. By manufacturing the subcombination at a first location, and shipping sealed to a second location, flexible manufacture can be achieved. The second location can add locally popular product and decoration.

14 Claims, 8 Drawing Sheets

Related U.S. Application Data

13/108,198, filed on May 16, 2011, now Pat. No. 9,701,430.

(51) Int. Cl.
*B65B 61/26* (2006.01)
*B05B 9/08* (2006.01)

(56) References Cited

U.S. PATENT DOCUMENTS 3,613,960 A 10/1971 Beard et al.
4,045,860 A 9/1977 Winckler
4,964,540 A 10/1990 Katz
4,969,577 A 11/1990 Werding
5,115,944 A 5/1992 Nikolich
5,174,344 A 12/1992 Gonzalez-Miller et al.
5,219,005 A 6/1993 Stoffel
5,248,063 A 9/1993 Abbott
5,277,336 A 1/1994 Yquel et al.
5,497,911 A 3/1996 Ellion et al.
5,505,039 A 4/1996 Maier
5,523,519 A 6/1996 Weber
5,622,282 A 4/1997 Yazawa et al.
5,832,965 A 11/1998 Fasse et al.
5,839,623 A 11/1998 Losenno et al.
5,927,551 A 7/1999 Taylor et al.
5,964,258 A 10/1999 Schoenbauer
6,019,252 A 2/2000 Benecke et al.
6,116,296 A 9/2000 Turunen
6,226,346 B1 5/2001 Zang et al.
6,736,288 B1 5/2004 Green
7,028,866 B2 4/2006 Kunesh et al.
7,124,788 B2 10/2006 Pericard
7,201,191 B2 4/2007 Heatley et al.
7,303,087 B2 12/2007 Flashinski et al.
7,344,707 B2 3/2008 Smith et al.
7,779,608 B2 8/2010 Lim et al.
7,789,278 B2 9/2010 Ruiz de Gopegui et al.
7,828,173 B2 11/2010 Geier et al.
8,074,847 B2 12/2011 Smith
8,091,741 B2 1/2012 Pritchard
8,596,557 B2 12/2013 Yamamoto et al.
8,752,731 B2 6/2014 Nimmo et al.
2005/0127022 A1 6/2005 Flashinski et al.
2005/0185067 A1 8/2005 Lim et al.
2006/0049205 A1 3/2006 Green
2006/0054634 A1 3/2006 Mekata
2006/0260714 A1 11/2006 Heatley et al.
2007/0241132 A1* 10/2007 Smith ..... B65D 83/38 222/95
2007/2782531 12/2007 Ruiz de Gopegui et al.
2008/0035214 A1 2/2008 McCormack et al.
2008/0272145 A1 11/2008 Nimmo et al.
2008/0314475 A1 12/2008 Fransen
2009/0236363 A1 9/2009 Haley
2010/0264165 A1 10/2010 Hansen et al.
2011/0017701 A1 1/2011 Soliman
2011/0083955 A1 4/2011 Tirtowidjojo et al.
2011/0108574 A1* 5/2011 Nimmo ..... B65B 31/003 222/95

OTHER PUBLICATIONS

U.S. Appl. No. 14/736,296, filed Jun. 11, 2015, Smith, et al.
U.S. Appl. No. 13/108,328, filed May 16, 2011, Smith.
U.S. Appl. No. 14/516,594, filed Oct. 17, 2014, Smith, et al.

* cited by examiner

COMPONENTS FOR AEROSOL DISPENSER

FIELD OF THE INVENTION

The present invention relates to aerosol dispensers and the manufacture of components thereof.

BACKGROUND OF THE INVENTION

Aerosol dispensers are well known in the art. Aerosol dispensers typically comprise an outer container which acts as a frame for the remaining components and as a pressure vessel for propellant and product contained therein. Outer containers made of metal are well known in the art. However, metal containers can be undesirable due to high cost and limited recyclability.

The outer containers are typically, but not necessarily, cylindrical. The outer container may comprise a bottom for resting on horizontal surfaces such as shelves, countertops, tables etc. The bottom of the outer container may comprise a re-entrant portion as shown in U.S. Pat. No. 3,403,804. Sidewalls defining the shape of the outer container extend upwardly from the bottom to an open top.

The open top defines a neck for receiving additional components of the aerosol dispenser. The industry has generally settled upon a neck diameter of 2.54 cm, for standardization of components among various manufacturers, although smaller diameters, such as 20 mm, are also used. Various neck shapes are shown in US 2007/02782531 A1; U.S. Pat. Nos. 7,303,087; 7,028,866; and commonly assigned U.S. Pat. No. 6,019,252.

Typically a valve cup is inserted into the neck. The valve cup is sealed against the neck to prevent the escape of the propellant and loss of pressurization. The valve cup holds the valve components which are movable in relationship to the balance of the aerosol dispenser.

Aerosol dispensers, having a valve cup and movable valve components, may comprise different embodiments for holding, storing, and dispensing product used by the consumer. In one embodiment, the product and propellant are intermixed. When the user actuates the valve, the product and propellant are dispensed together. This embodiment may utilize a dip tube. The dip tube takes the product and propellant mixture from the bottom of the outer container. By dispensing from the bottom of the outer container, the user is more likely to achieve dispensing of the product/propellant mixture and not dispense pure propellant from the headspace. This embodiment may be used, for example, to dispense shaving cream foams.

The dip tube embodiment of an aerosol dispenser has the disadvantage that when the user tips the aerosol dispenser from a vertical orientation, dispensing of gas from the headspace, rather than dispensing of product/propellant mixture, may occur. This disadvantage may occur when the aerosol dispenser contains a product such as a body spray, which the user dispenses all over his/her body, often from inverted positions.

To overcome this disadvantage, other embodiments could be utilized. For example, a collapsible, flexible bag may be sealed to the opening on the underside of the valve cup or may be placed between the valve cup and the container. This bag limits or even prevents intermixing of the contents of the bag and the components outside of the bag. Thus, product may be contained in the bag. Propellant may be disposed between the outside of the bag and the inside of the outer container. Upon actuation of the valve, a flow path out of the bag is created. Gage pressure from the propellant disposed between the bag and the outer container causes pressurization of the product, forcing the product to flow into ambient pressure. This embodiment is commonly called a bag on valve and may be used, for example, in dispensing shaving cream gels. In either embodiment, flow to the ambient may comprise droplets, as used for air fresheners or may comprise deposition on a target surface, as may occur with cleansers.

The process for manufacturing a bag on valve type aerosol dispenser is complicated. One the filling operation is used to pressurize the outer container with propellant. This filling operation may utilize hydrocarbon propellant and/or inert gas propellant, such as Tetrafluoroprop-1-ene commercially available from Honeywell Company of Morristown, N.J.

Specialized equipment is typically used for pressurizing the outer container with the various propellant gases. If a hydrocarbon propellant is selected, the manufacturing process becomes more complex and costly due to safety concerns, environmental regulations and other industry regulations.

Propellant filling of aerosol dispensers presents its own challenges. Propellant must be added to the outer container, without contaminating the inside of the bag, if present. Further, leakage to the ambient must be minimized. And the relevant portions of the aerosol container must be sealed in a manner to prevent later leakage and depressurization after shipment, handling and storage.

Yet different equipment must be utilized for disposing the desired product into the bag. Often, the outer container pressurization and disposing of product inside the bag occur in two separate operations at the same location. This manufacturing process is influenced by industry regulations governing transport, storage and shipping of pressure vessels, such as an aerosol dispenser. Thus, to avoid extra shipping operations, the pressurization step and product filling step often occur at the same site.

However, utilizing a common site for pressurization and filling of the aerosol dispenser presents certain problems and inherent fixed costs. For example, each manufacturing site must have the complex and highly regulated propellant pressurizing equipment and safety systems. Yet, multiple manufacturing sites may be desirable if the product is to be shipped to several geographies.

Conversely, if a single manufacturing site is used to source multiple geographies, that site must be knowledgeable in specific products and consumer preferences for each geography. Some of the geographies may be remote. A single manufacturing site may not be able to quickly respond to changes in consumer preference or to tailor the product to the unique consumer preferences in different geographies. Different geographies may further have different labeling requirements and languages. Additionally, import duties and taxes for finished products are typically higher than the duties and taxes for intermediates exported to that same country.

Thus, limiting complex manufacturing to fewer sites/first regions, then exporting a product to a second region for completing the manufacturing process may be viable. Such manufacturing may provide cost benefits for the product and convenient customization of the product for the second region.

SUMMARY OF THE INVENTION

The invention comprises pressurized container usable for an aerosol dispenser. The container has an outer container having an opening for receiving an optional valve cup, optionally a valve cup sealed to the opening of the outer container and having a hole therethrough for receiving a valve assembly therein, an empty product delivery device for holding product and being in fluid communication with a valve assembly, the empty product delivery device being sealed to the valve cup and disposed intermediate the valve cup and outer container; and a propellant disposed within said outer container.

DETAILED DESCRIPTION OF THE INVENTION

Figure 1:
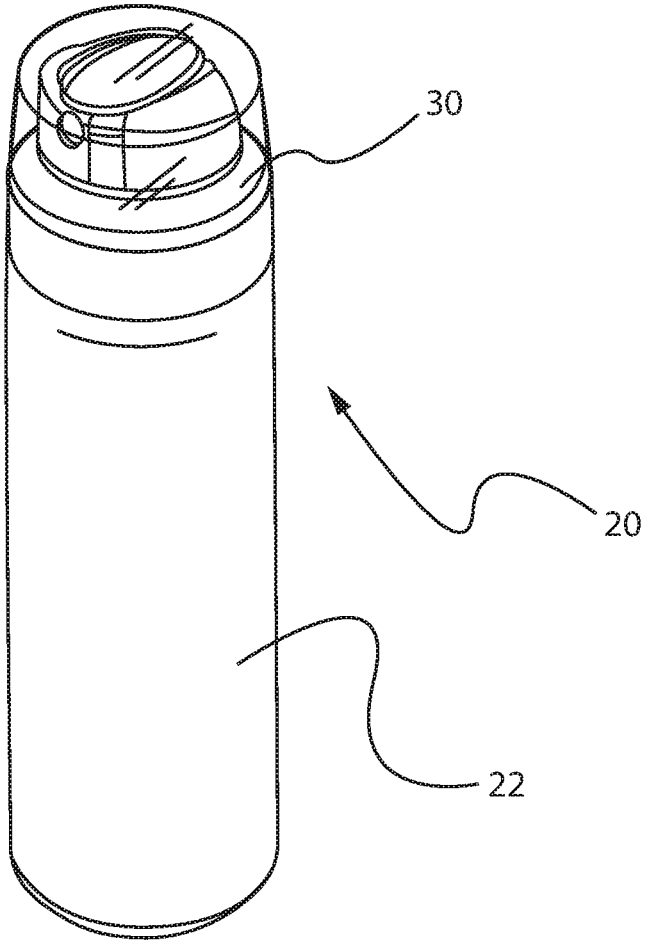
FIG. 1 is a perspective view of an aerosol dispenser according to the present invention having a plastic outer container and a bag.
Figure 2A:
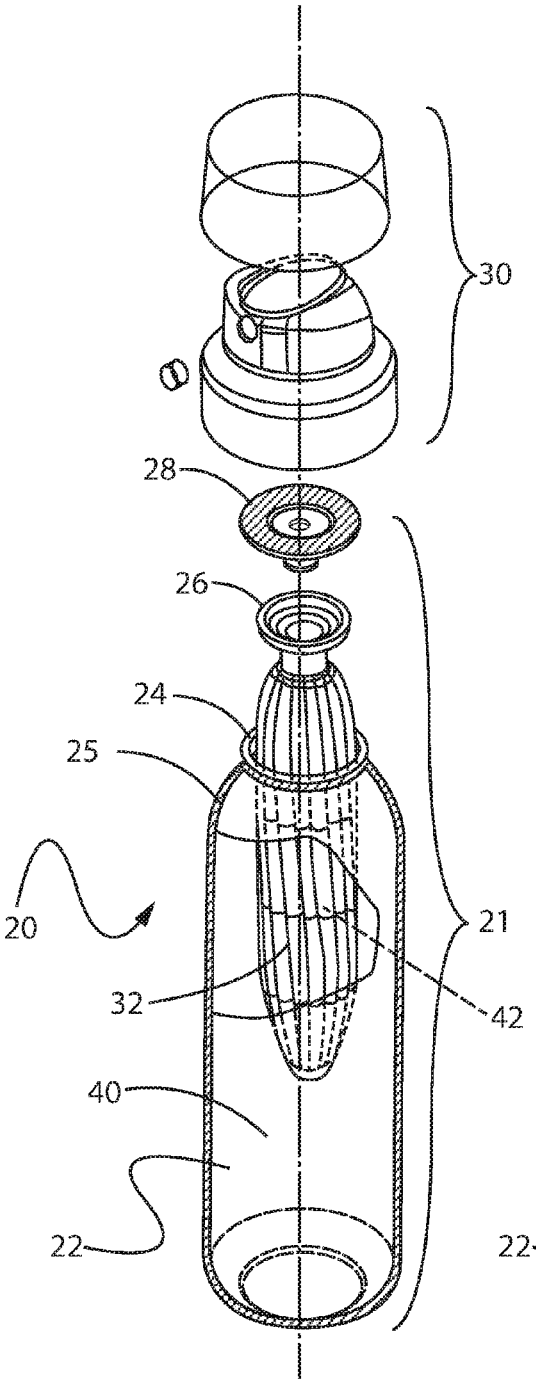
FIG. 2A is an exploded perspective view of the aerosol dispenser of FIG. 1 having a collapsible bag.
Figure 2B:
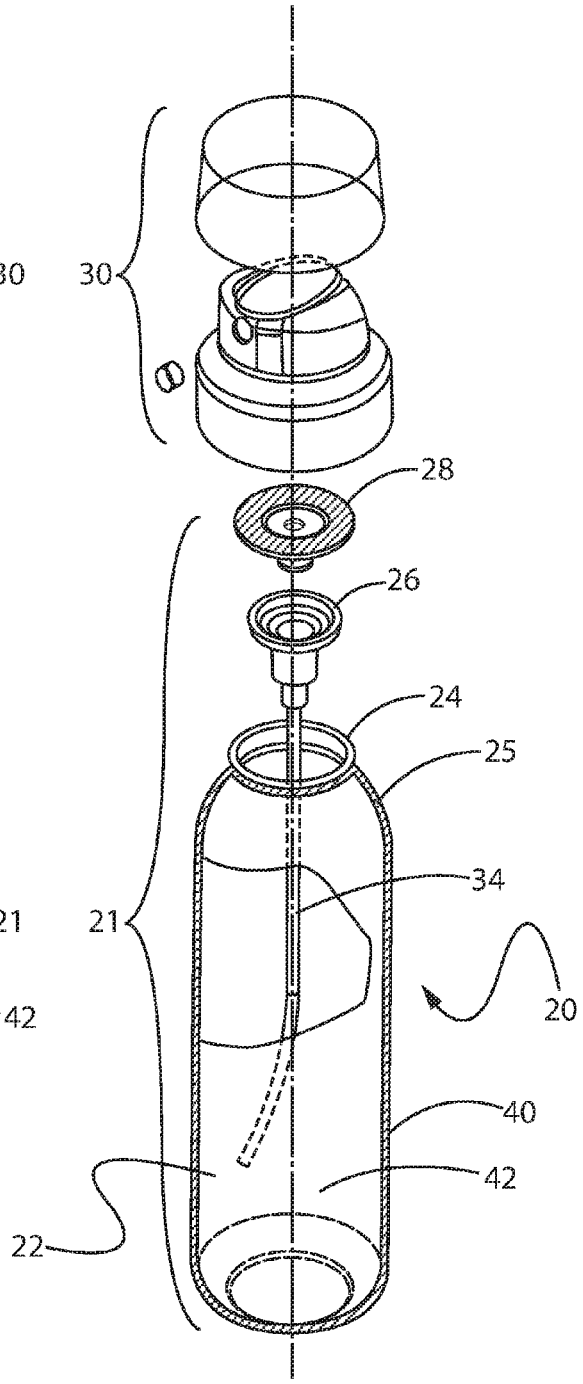
FIG. 2B is an exploded perspective view of the aerosol dispenser of FIG. 1 having a dip tube.

Referring to FIGS. 1, 2A and 2B, an aerosol dispenser 20 is shown. The aerosol dispenser 20 comprises a pressurizeable outer container 22 usable for such a dispenser. The outer container 22 may comprise plastic or metal, as are known in the art. The outer container 22 may have an opening. The opening is typically at the top of the pressurizeable container when the pressurizeable container is in its-in use position. The opening defines a neck 24, to which other components may be sealed.

A valve cup 26 may be sealed to the opening of the outer container 22, as described in further detail below. A valve assembly 28, in turn, may be disposed within the valve cup 26. The valve assembly 28 provides for retention of product 42 within the aerosol dispenser 20 until the product 42 is selectively dispensed by a user. The valve assembly 28 may be selectively actuated by an actuator 30. Neither the valve assembly 28 nor the actuator 30 form any part of the claimed invention.

Selective actuation of the valve assembly 28 allows the user to dispense a desired quantity of the product 42 on demand. Illustrative and nonlimiting products 42 for use with the present invention may include shave cream, shave foam, body sprays, body washes, perfumes, cleansers, air fresheners, astringents, foods, paints, etc.

Inside the outer container 22 may be a product delivery device. The product delivery device may comprise a collapsible bag 32 as shown in FIG. 2A. The collapsible bag 32 may be mounted in sealing relationship to the neck 24 of the container and/or to the valve assembly 28. This arrangement is known in the art as a bag-on-valve. The collapsible bag 32 may hold product 42 therein, and prevent intermixing of such product 42 with propellant 40. The propellant 40 may be stored outside the collapsible bag 32, and inside the outer container 22.

The collapsible bag 32 may expand upon being charged with product 42. Such expansion decreases the available volume inside the outer container 22. Decreasing the available volume increases the pressure of any propellant 40 therein according to Charles law.

The product delivery device may alternatively or additionally comprise a dip tube 34 as shown in FIG. 2B. The dip tube 34 extends from a proximal end sealed to the valve assembly 28. The dip tube 34 may terminate at a distal end juxtaposed with the bottom of the outer container 22. This embodiment provides for intermixing of the product 42 and propellant 40. Both are co-dispensed in response to selective actuation of the valve assembly 28 by a user. Again, insertion of product 42 and/or propellant 40 into the outer container 22 increases pressure therein according to Charles law.

Referring to FIGS. 3A, 3B, 4 and 5, the aerosol dispensers 20, and components thereof, may have a longitudinal axis, and may optionally be axi-symmetric with a round cross section. Alternatively, the outer container 22, product delivery device, valve assembly 28, etc., may be eccentric and have a square, elliptical or other cross section.

Figure 3A:
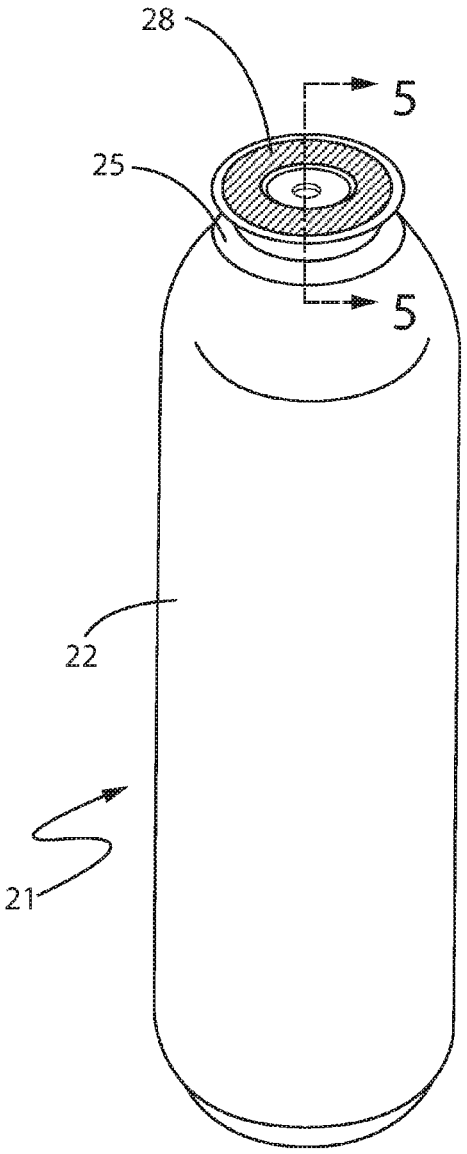
FIG. 3A is a perspective view of the pressurizable container of the aerosol dispenser of FIG. 1 having a plastic outer container.
Figure 3B:
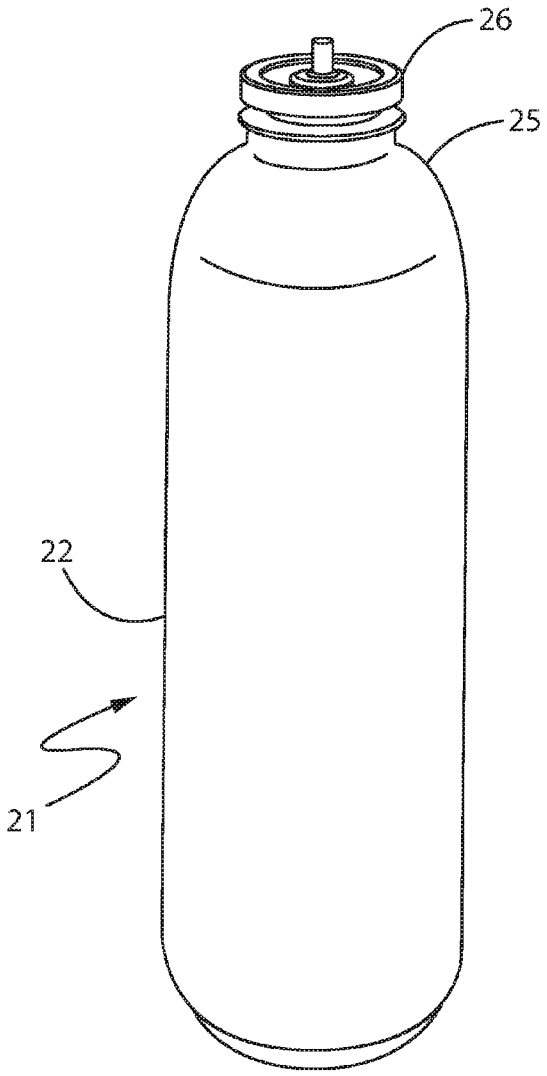
FIG. 3B is a perspective view of a perspective view of a pressurizable container according to the present invention having a metal outer container and a clinched valve cup.
Figure 4:
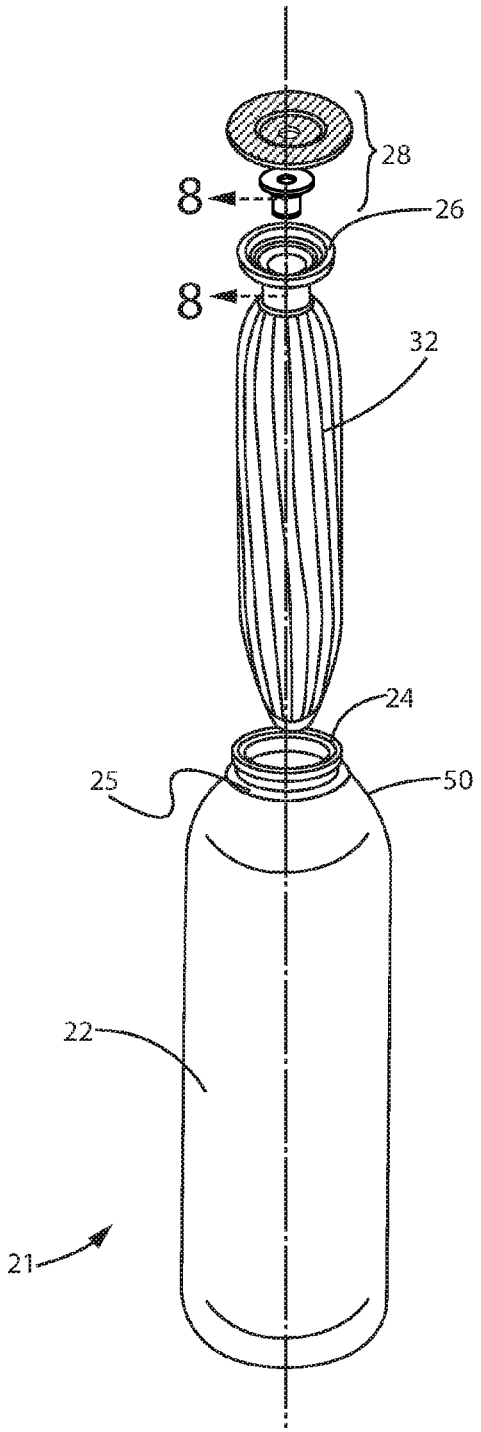
FIG. 4 is an exploded perspective view of the pressurizable container of FIG. 3A and having an outer container, bag, valve cup and valve assembly.
Figure 5:
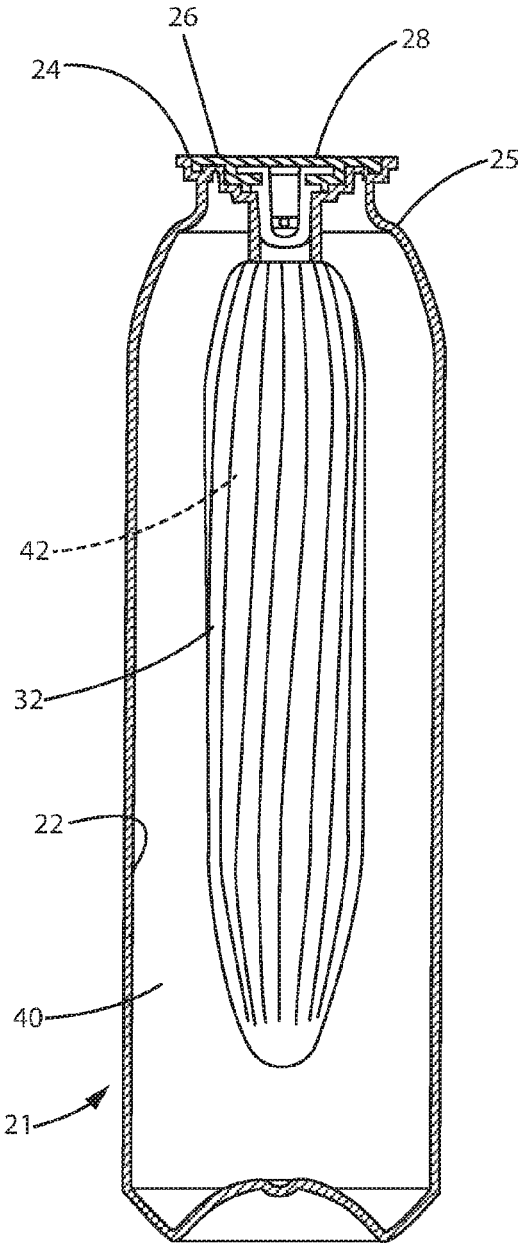
FIG. 5 is a vertical sectional view of the pressurizable container of FIG. 3A.

Referring particularly to FIGS. 3A, 4 and 5 the outer container 22 may comprise a plastic pressurizeable container. The plastic may be polymeric, and particularly comprise PET. The valve assembly 28, and optional valve cup 26 may be welded to the neck 24 of the outer container 22, as discussed below. Referring to particularly to FIG. 3B, the outer container 22 may be made of metal, such as steel and/or aluminum. If so, the valve cup 26 may be clinched to the neck 24 in known fashion.

Figure 6:
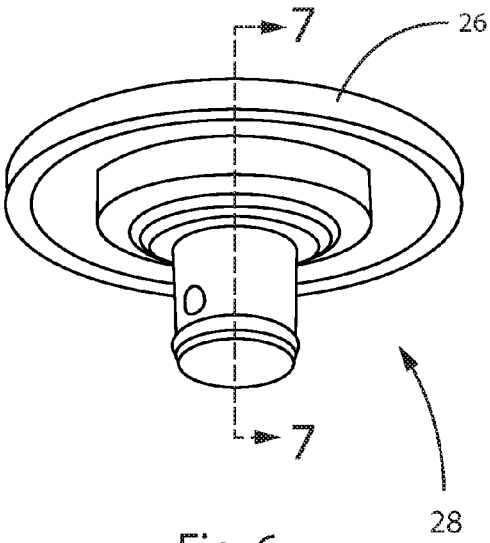
FIG. 6 is a perspective view of a representative valve assembly usable with the aerosol dispenser of the present invention.
Figure 7:
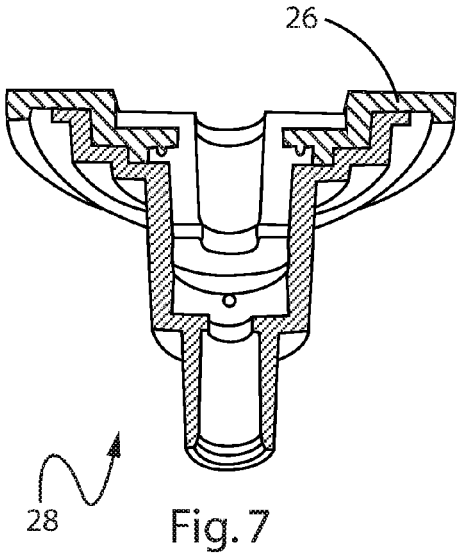
FIG. 7 is a vertical sectional view of the valve assembly of FIG. 6, as inserted into a sleeve.

Referring to FIGS. 6-7, any number of known valve assemblies may be usable with the present invention. One suitable and non-limiting example, is shown. In this example, a rigid sleeve 54 may be attached to the top of the bag with an impermeable seal. An elastically deformable plug may be tightly inserted into the sleeve 54. Longitudinal movement of the plug, in the downward direction and within the sleeve 54 may allow product 42 to be selectively dispensed. The sleeve 54 may be impermeably joined to an optional valve cup 26. The valve cup 26, in turn, may be joined to the neck 24 of the outer container 22. A suitable plug and sleeve 54 type valve assembly 28 may be made according to the teachings of commonly assigned publications 2010/0133301A1 and/or 2010/0133295A1.

The pressurizeable container may further include a propellant 40. The propellant 40 may be disposed between the outer container 22 and the product delivery device. Alternatively propellant 40 may be disposed in the outer container 22 and/or the collapsible bag 32. Typically the pressure in the outer container 22 is greater than the pressure in the collapsible bag 32, so that product 42 may be dispensed from within the bag. If a dip tube 34 is selected for the product delivery device, the propellant 40 and product 42 may be intermixed, and thus co-dispensed. The pressure of the propellant 40 within the outer container 22 provides for dispensing of the product 42/co-dispensing of product 42/propellant 40 to ambient, and optionally to a target surface. The target surface may include a surface to be cleaned or otherwise treated by the product 42, skin, etc. Such dispensing occurs in response to the user actuating the valve assembly 28.

Referring generally to FIGS. 3A, 3B, 4 and 5, and examining the components in more detail, the pressurizeable container may comprise an outer container 22 having a hole with a valve cup 26 therein or disposable therein. A user activated valve assembly 28 may be disposed in the valve cup 26. A product delivery device may be joined to the valve cup 26. Propellant 40 may be disposed between the outer container 22 and the product delivery device. The product 42 and propellant 40 may be separately dispensed or may be dispensed together.

If the product delivery device comprises a flexible, collapsible bag 32, the pressure boundary for the propellant 40 is formed, in part, by the collapsible bag 32. If the product delivery device comprises a dip tube 34, the pressure boundary for the propellant 40 is formed, in part by the underside of the valve assembly 28 when the valve is closed.

If desired, the outer container 22, valve cup 26, valve assembly 28, dip tube 34 and/or collapsible bag 32 may be polymeric. By polymeric it is meant that the component is formed of a material which is plastic, comprises polymers, and/or particularly polyolefin, polyester or nylons. Thus, the entire aerosol dispenser 20 or, specific components thereof, may be free of metal, allowing exposure to microwave energy.

Thus, an aerosol dispenser 20, or pressurizable container 21 therefor, according to the present invention may be microwavable. Microwave heating of the aerosol dispenser 20 or pressurizable container 21 therefor provides for heating of the product 42 prior to dispensing. Heating of the product 42 prior to dispensing may be desirable if the product 42 is applied to the skin, becomes more efficacious at lower viscosities, or is to be eaten.

If desired, the outer container 22, collapsible bag 32, and/or dip tube 34, may be transparent or substantially transparent. If both the outer container 22 and a collapsible bag 32 used as the product delivery device are transparent, this arrangement provides the benefit that the consumer knows when product 42 is nearing depletion and allows improved communication of product 42 attributes, such as color, viscosity, etc. Also, labeling or other decoration of the container may be more apparent if the background to which such decoration is applied is clear. Alternatively or additionally, the outer container 22, collapsible bag 32, etc. may be transparent and colored with like or different colors.

The outer container 22 may define a longitudinal axis of the aerosol dispenser 20. The outer container 22 may be axisymmetric as shown, or, may be eccentric. While a round cross-section is shown, the invention is not so limited. The cross-section may be square, elliptical, irregular, etc. Furthermore, the cross section may be generally constant as shown, or may be variable. If a variable cross-section is selected, the outer container 22 may be barrel shaped, hourglass shaped, or monotonically tapered.

The outer container 22 may range from 6 to 40 cm in height, taken in the axial direction and from 4 to 60 cm in diameter if a round footprint is selected. The outer container 22 may have a volume ranging from 115 to 1000 cc exclusive of any components therein, such as a product delivery device. The outer container 22 may be injection stretch blow molded. If so, the injection stretch blow molding process may provide a stretch ratio of greater than 8, 8.5, 9, 9.5, 10, 12, 15 or 20.

The outer container 22 may sit on a base. The base is disposed on the bottom of the outer container 22 and of the aerosol dispenser 20. Suitable bases include petaloid bases, champagne bases, hemispherical or other convex bases used in conjunction with a base cup. Or the outer container 22 may have a flat base with an optional punt.

A punt is a concavity in the bottom of the container and extending towards the neck 24 of the container. A punt is distinguishable from a general concavity in the bottom of a container, as a punt has a smaller diameter than is defined by the footprint of the bottom of the container. The punt may be axisymmetric about the longitudinal axis. The vertex of the punt may be coincident the longitudinal axis.

The outer container 22 sidewall also defines a diameter. The sidewall and bottom of the container may be connected by a chamfer. As used herein a chamfer refers to an angled wall which is substantially flat as taken in the radial direction. The chamfer may be angled, relative to the longitudinal axis, at least 30, 35 or 40° and not more than 60, 55 or 50°. In a degenerate case, the chamfer may be angled at 45° relative to the longitudinal axis.

If desired, the bottom of the container may comprise radially oriented internal ribs. The ribs may be of like geometry, and be spaced outwardly from the longitudinal axis. Each rib may intercept the sidewall of the outer container 22. The ribs may be equally circumferentially spaced from adjacent ribs.

It has been found that a plastic outer container 22 conforming to the aforementioned radius percentage and punt diameter to area ratio does not creep under pressures ranging from 100 to 970 kPa, and having a sidewall thickness less than 0.5 mm. The outer container 22 may be pressurized to an internal gage pressure of 100 to 970, 110 to 490 or 270 to 420 kPa. A particular aerosol dispenser 20 may have an initial propellant 40 pressure of 1100 kPA and a final propellant 40 pressure of 120 kPa, an initial propellant 40 pressure of 900 kPA and a final propellant 40 pressure of 300 kPa, an initial propellant 40 pressure of 500 kPA and a final propellant 40 pressure of 0 kPa, etc.

The aerosol dispenser 20, as presented to a user may have an initial pressure. The initial pressure is the highest pressure encountered for a particular filling operation, and corresponds to no product 42 yet being dispensed from the product delivery device. As product 42 is depleted, the outer container 22 approaches a final pressure. The final pressure corresponds to depletion of substantially all product 42, except for small residual, from the product delivery device.

Thus, a suitable outer container 22 can be made without excessive material usage and the associated cost and disposal problems associated therewith. By reducing material usage, the user can be assured that excessive landfill wasted is not produced and the carbon footprint is reduced.

As the top of the outer container 22 is approached, the outer container 22 may have a neck 24. The neck 24 may be connected to the container sidewall by a shoulder 25. The shoulder 25 may more particularly be joined to the sidewall by a radius. The shoulder 25 may have an annular flat. The neck 24 may have a greater thickness at the top of the outer container 22 than at lower portions of the neck 24 to provide a differential thickness. Such differential thickness may be accomplished through having an internally stepped neck 24 thickness.

Any suitable propellant 40 may be used. The propellant 40 may comprise a hydrocarbon as is known as in the art, nitrogen, air and mixtures thereof. Propellant 40 listed in the US Federal Register 49 CFR 173.115, Class 2, Division 2.2 are considered acceptable. The propellant 40 may particularly comprise a Trans-1,3,3,3-tetrafluoroprop-1-ene, and optionally a CAS number 1645-83-6 gas.

Such propellant 40 provide the benefit that they are not flammable, although the invention is not limited to inflammable propellant 40. One such propellant 40 is commercially available from Honeywell International of Morristown, N.J. under the trade name HFO-1234ze or GWP-6.

If desired, the propellant 40 may be condensable. By condensable, it is meant that the propellant 40 transforms from a gaseous state of matter to a liquid state of matter within the outer container 22 and under the pressures encountered in use. Generally, the highest pressure occurs after the aerosol dispenser 20 is charged with product 42 but before that first dispensing of that product 42 by the user. A condensable propellant 40 provides the benefit of a flatter depressurization curve as product 42 is depleted during usage.

A condensable propellant 40 provides the benefit that a greater volume of gas may be placed into the container at a given pressure. Upon dispensing of a sufficient volume of product 42 from the space between the outer container 22 and the product delivery device, the condensable propellant 40 may flash back to a gaseous state of matter.

The propellant 40 may be provided at a pressure corresponding to the final pressure of the aerosol dispenser 20 when substantially all product 42 is depleted therefrom. The propellant 40 may be charged to a pressure of less than or equal to 300, 250, 225, 210, 200, 175 or 150 kPa. The propellant 40 may be charged to a pressure greater than or equal to 50, 75, 100 or 125 kPa.

Figure 8:
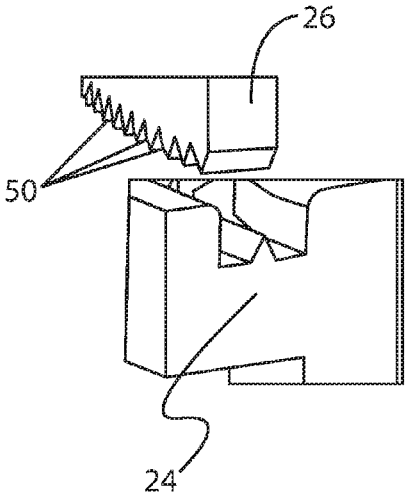
FIG. 8 is a fragmentary exploded perspective view of the valve cup and neck of the outer container of FIGS. 3A, 4 and 5.
Figure 9:
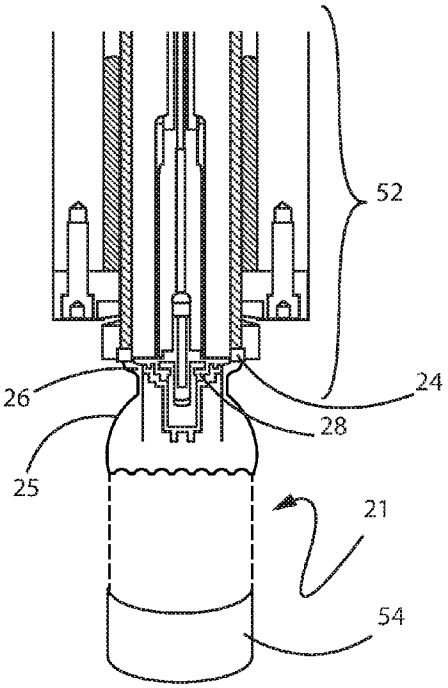
FIG. 9 is a schematic sectional view of a representative manifold engaging a pressurizeable outer container for filling with propellant.

Referring to FIGS. 8 and 9 the optional valve cup 26 may be sealed to the top of the outer container 22 while the outer container 22 is pressurized. The sealing process may be accomplished by providing the outer container 22 and valve cup 26. One of skill will understand that if the valve assembly 28 fits to the neck 24, the optional valve cup 26 may be omitted. In such an embodiment, the valve assembly 28 is directly sealed to the neck 24. While the following description is directed to incorporating a valve cup 26, one of skill will recognize the invention is not so limited.

The valve cup 26 may have a valve cup 26 periphery complementary to the neck 24 periphery. At least one of the valve cup 26 and/or container neck 24 may have a channel 50 therethrough. Additionally or alternatively, the channel 50 may be formed at the interface between the valve cup 26 and container neck 24.

A channel 50 is considered to be functional, so long as it allows fluid communication from the ambient, or more particularly a filling manifold 52, into the outer container 22. In a degenerate case, the channel 50 may be coincident a radial direction or parallel to the longitudinal axis.

A plurality of radial channel 50 may be provided, to allow for faster filling of the propellant 40. The plurality of radial channel 50 may be generally equally circumferentially spaced or unequally spaced about the periphery of the outer container 22 and/or valve cup 26. Likewise, the plurality of radial channel 50 made be of equal or unequal cross-section and of constant or variable cross-section. In a degenerate case, a single radial channel 50 may be provided.

After the valve cup 26 is disposed onto the neck 24 of the container, or the top of the container if no neck 24 is utilized, the filling manifold 52 is applied over the valve cup 26. The manifold 52 is in fluid communication with a supply of propellant 40 and with at least one channel 50.

The manifold 52 temporarily seals to an anvil. The anvil provides a temporary seal for the moving portion of the manifold 52. The anvil may comprise a sleeve 54 into which the outer container 22 is placed. The sleeve 54 may be used to transport the pressurizable/pressurized container between stations during manufacture. Additionally or alternatively, the shoulder 25 of the outer container 22 may be used as the anvil.

The temporary seal may be accomplished through compression, applied in the longitudinal direction, between the manifold 52 and the anvil. One of skill will understand that at least one channel 50 may be disposed through the sidewall, bottom, neck 24 and/or other suitable positions on the outer container 22. Any such arrangement may be used, so long as a seal is established and the channel 50 is sealed, as described below.

After the temporary seal is established, propellant 40 is introduced into the manifold 52 and flows, under pressure, from the supply, through one or a plurality of channel 50, and into the outer container 22. This step provides pressure to the inside of the outer container 22. If a compressible flexible bag is selected for the product delivery device, the propellant 40 remains outside of the bag and the bag remains empty.

When the desired propellant 40 pressure is reached, the valve cup 26 may be sealed to the neck 24 or top of the outer container 22 to prevent leakage therefrom. If channel 50 are used in a location other than at the interface between the valve cup 26 and container neck 24, such channel 50 may likewise be sealed.

Sealing may occur through sonic welding or untrasonic welding as are known in the art. Alternatively or additionally, sealing may occur through spin welding, vibration welding, adhesive bonding, laser welding, or fitting a plug into the port as are known in the art. If desired, the valve cup 26 and the outer container 22 may have identical, or closely matched, melt indices, to improve sealing. A welding apparatus is available from Branson Ultrasonics Corp., of Danbury Conn.

Referring back to FIG. 3A, if desired, the channel 50 may not be radially oriented, but instead may be axially oriented. Axial channel 50 may have an orientation primarily in the axial direction and provide fluid communication from the ambient to the inside of the outer container 22. Of course channel 50 may be oriented in a skewed direction relative to the radial direction and the longitudinal direction.

One of skill will recognize channel 50 having a combination of orientations may be utilized, so long as a filling manifold 52 having complementary sealing is provided. One of skill will further recognize that plural manifold 52 may be utilized. Plural manifold 52 provide the benefit that each manifold 52 may have a different propellant 40, and the propellant 40 are not intermixed until filling occurs. Plural manifold 52 may also provide the benefit that different manifold 52 may be tailored to different channel 50, so that a proper seal occurs during filling.

When the outer container 22 is pressurized with propellant 40 to the desired pressure and the valve cup 26 is sealed thereon, the manifold 52 may be removed. Thus, under this manufacturing process, the valve cup 26 and outer container 22 are sealed while under pressure from the manifold 52 propellant 40. The sealing step may occur during or after the propellant 40 charging step.

During the propellant 40 charging operation, if desired, the collapsible bag 32 may be opened with a plunger. The plunger allows air within the bag to escape. As the bag collapses due to increasing pressure from the propellant 40, air will be evacuated therefrom. Such evacuation minimizes problems during the sealing operation.

If desired, the valve cup 26 may be sealed to the container utilizing a press fit, interference fit, solvent welding, laser welding, vibration welding, spin welding, adhesive or any combination thereof. An intermediate component, such as a sleeve 54 or connector may optionally be disposed intermediate the valve cup 26 and neck 24 or top of the outer container 22. Any such arrangement is suitable, so long as a seal adequate to maintain the pressure results.

Figure 10:
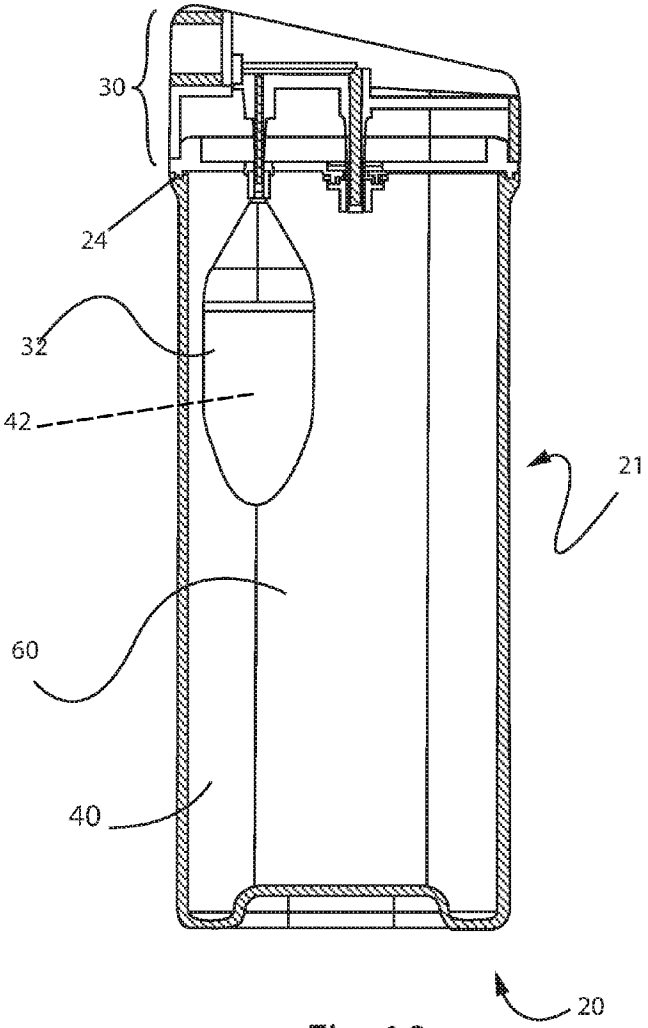
FIG. 10 is a vertical sectional view an aerosol dispenser having a bag and plural valve assemblies in a single outer container.

Referring to FIG. 10, plural valves may be used with a single outer container 22. This arrangement provides the benefit that product 42 and propellant 40 are mixed at the point of use, allowing synergistic results between incompatible materials. This arrangement also provides the benefit that delivery of the propellant 40 provides motive force to the product 42, often resulting in smaller particle size distributions. Smaller particle size distributions can be advantageous for uniform product 42 distribution and minimizing undue wetting.

This arrangement provides the additional benefit that relative proportions of different materials may be tuned to a particular ratio for dispensing. For example, a product 42 may be dispensed and having a 3.5:1 ratio of a first component to a second component. While FIG. 10 illustrates an aerosol dispenser 20 having two valve assemblies, one of skill will recognize the invention is not so limited. The aerosol dispenser 20 may have three, four or more valve assemblies, with a like number of or lesser number of chambers 60 to isolate different product 42 materials until the point of use.

Figure 11A:
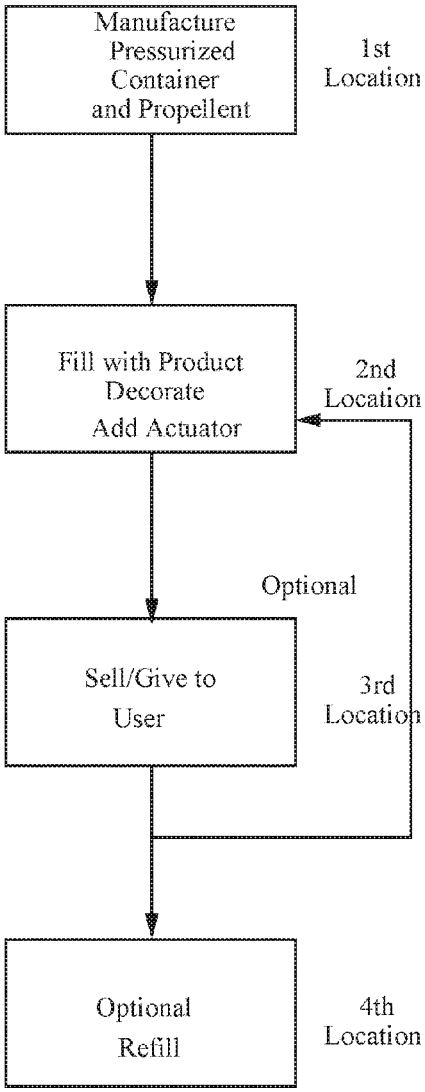
FIG. 11A is a schematic block diagram of a divided manufacturing process according to the present invention having the container pressurized at the point of manufacture.

Referring to FIG. 11A, if desired the manufacture of the pressurizeable container according to the present invention may be divided into two or more phases according to time and/or location. For example, the outer container 22, valve cup 26, valve assembly 28, product delivery device and propellant 40 may be manufactured as a unit.

Such a unit may comprise a pressurizeable container. The product delivery device, as manufactured, is empty. By empty it is meant that the product delivery device contains no product 42 or traces thereof. Further, an product delivery device has never contained product 42. Further, the product delivery device contains no air other than atmospheric or residual air inherent to the manufacturing process. If the product delivery device has been filled and depleted, it is no longer considered empty. Empty is a state which exists only prior to the first filling of the product delivery device with product 42. Further the empty state must last longer than an incidental period of a few seconds during transport between stations to be considered a state.

Thus, if the empty product delivery device comprises a collapsible bag 32, the bag may have an open end joined and sealed to the valve cup 26. However, the bag has no product 42 and no air at a pressure greater than atmospheric therein.

Alternatively, if the product delivery device comprises a dip tube 34, the dip tube 34 is open to the inside of the outer container 22. The inside of the empty outer container 22 contains no product 42, but may contain propellant 40 at a pressure greater than atmospheric pressure.

In a first phase of manufacture, the pressurizeable container may be manufactured to have a propellant 40 therein. Propellant 40 is contained between the outer container 22 and the bag or within the outer container 22 if a dip tube 34 is used. Thus, at the end of the first phase of manufacture, the pressurized but container has propellant 40 sealed and pressurized therein but no product 42. The propellant 40 pressure may be selected according to the dispensing conditions. The pressure within the pressurized container as manufactured and prior to charging with the product 42 may correspond to the final pressure that the user encounters when product 42 is depleted.

Product 42 may be charged into the container through the valve assembly 28, as is known in the art. When product 42 is charged into the container, the product 42 increases the pressure of the propellant 40. The increase in propellant 40 pressure occurs due to the increase in volume of the collapsible bag 32 if such a bag is used as a product delivery device. Likewise, the increase in propellant 40 pressure occurs due to the increase in the number of moles of product 42 in the outer container 22 if a dip tube 34 is selected.

The pressurizeable container may be charged with an amount of product 42 which brings the pressure, as initially presented to the user, sufficient to dispense and substantially deplete the product 42 from the aerosol dispenser 20. The final pressure, after substantially all product 42 is depleted, is less than the initial pressure.

The pressure of the propellant 40 at the end of the first phase of manufacture may correspond to the pressure at the end of the usable life of the aerosol dispenser 20, herein referred to as the final pressure. The pressure of the propellant 40 at the end of the second phase of manufacture may correspond to the pressure as initially presented to the user.

By dividing the manufacture into plural phases, unexpected cost reduction and manufacturing flexibility may result. Particularly, manufacturing plants using propellant 40 are typically required, based upon country location, to meet more stringent environmental and safety requirements than plants which do not involve propellant 40.

Thus, if desired, a limited number of plants may be selected to manufacture the pressurizeable container of the present invention. The pressurized containers may be shipped from the limited number of plants to other plants for completing the manufacturing process in a second phase, or in a plurality of later phases. Such plants may be at a first location or a respective plurality of first locations.

The plants used to complete the second and later phases of the manufacturing process may be the same plant is used to complete the first phase. But, advantageously, the plants used to complete the second and later phases, if necessary, of the manufacturing process may be remote from the plant used to complete the first phase and produce the pressurizable container 21.

Such plants may be disposed at a second location or a respective plurality of second locations. The second locations may be remote from, and domestically located in the same country as the first locations. Or the second locations may be remote from, and located in one or more foreign countries as the first locations. Or one or more plants at first locations may feed pressurizable containers 21 to remote second locations one or more of which is domestic relative to the first location and to one or more second locations located in one or more foreign countries as the first locations.

This arrangement provides the benefit that a pressurized container may be shipped from a first plant in a generic form having propellant 40 therein. The generic form has no label, no actuator 30 or other valve opening device and no product 42 therein. The pressurizable container 21 may then be shipped to a second, different and/or remotely located plant for local completion of the second phase of manufacture. The remotely located plant may be in the same country as the first plant, or may be in a different country, so that international shipping is only with the subcombination having the generic form.

By remote it is meant that the first plant and second plant are functionally separated so that specific transport therebetween is necessary. Transport may occur by truck, train, ship, combinations thereof, etc. Remote locations do not include separate rooms or facilities at a common plant.

During the second phase of manufacture the pressurizeable container is charged with product 42. The product 42 may be customized to the local country, or region thereof, where the second phase of manufacture is completed. For example, users in one particular country may prefer particular scents or greater amounts of scents. Users in another country may prefer greater amounts of disinfectant or product 42 free of a scent. Users in yet another country may prefer product 42 tinted to a particular color.

By conducting the second phase, and later phases if necessary, of manufacture at local plants, such particular user preferences may be more readily accommodated than if both phases of manufacture occur remotely from the point of sale. Furthermore, the local plant completing the second phase of manufacture can more quickly respond to local consumer preferences as they change in a particular country or geography.

Additionally, another advantage to the divided phase of manufacture is that individual regional decorating may occur. A label made in one country may not be optimum for aerosol dispensers 20 sold in another country. In a particular country, preferences may change or a particular fad may occur which would be desirable to add to the labeling or product 42. Localized label graphics may provide more efficient use of space, providing improved communication and greater value to the consumer. With the divided manufacture of the present invention, this efficiency and rapid changes may be accommodated more readily than if a single, plant conducts both phases of manufacture remote from the point of sale.

The divided manufacture provides yet another benefit. If desired, when the product 42 is depleted, the pressurized container may be refilled with a new charge of product 42. To do so, the user simply takes the pressurized container which is depleted of product 42 to filling station at yet another location. At this location, a new charge of product 42 installed into the product delivery device. The refill could occur through the same valve assembly 28 utilized for the initial product 42 charge. The refill may be the same product 42 as originally presented to the consumer or may be a different product 42 to accommodate changing consumer preferences.

In yet another embodiment, the user may purchase relatively larger pressurized container of product 42. When the product 42 is depleted from the aerosol dispenser 20, the user simply refills the product 42 from the larger pressurized container, which acts as a reservoir. This arrangement provides the convenience of not requiring a special trip to continue using the product 42.

This arrangement provides the benefit that the aerosol dispenser 20, including the propellant 40 therein, can be reused and not require additional materials for manufacturing a new, single use aerosol dispenser 20. This arrangement provides the further benefit that materials may be reused, and not prematurely discarded into a landfill.

Figure 11B:
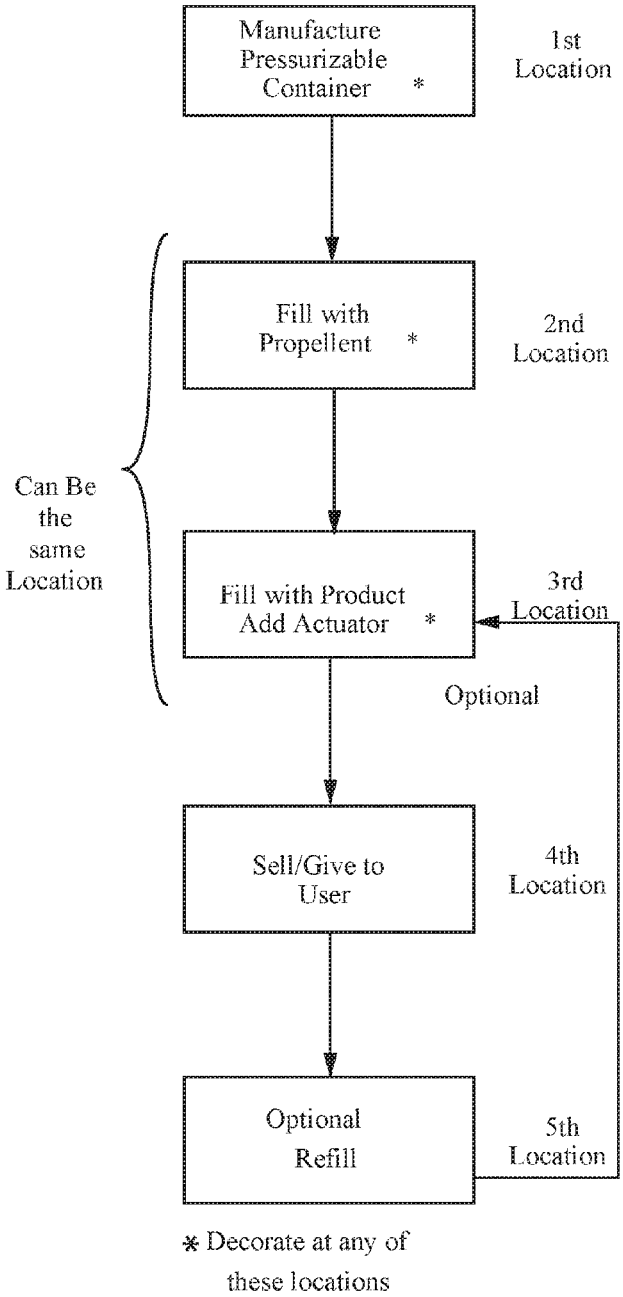
FIG. 11B is a schematic block diagram of a divided manufacturing process according to the present invention having the container pressurized at a second location, with product added at this location or a successive location.
Figure 12A:
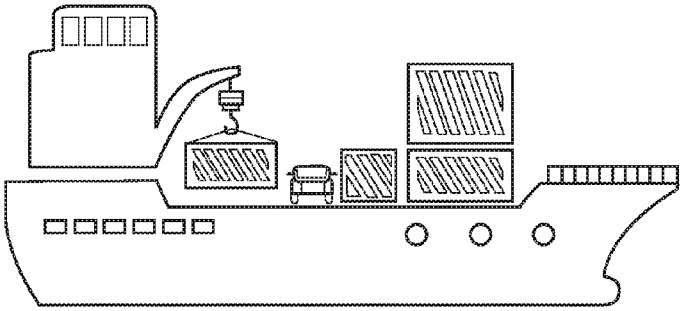
FIG. 12A is a view of a shipment of at least one pressurized container on a mode of transportation.
Figure 12B:
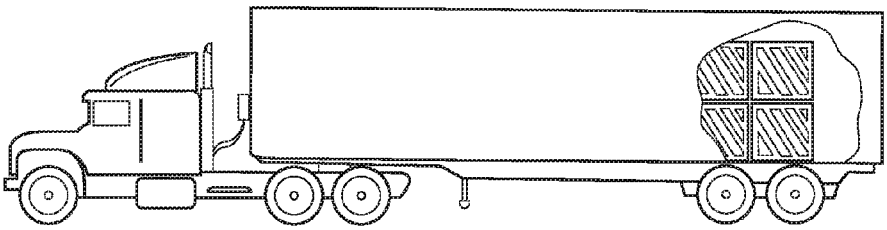
FIG. 12B is a view of the shipment on another mode of transportation.
Figure 12C:
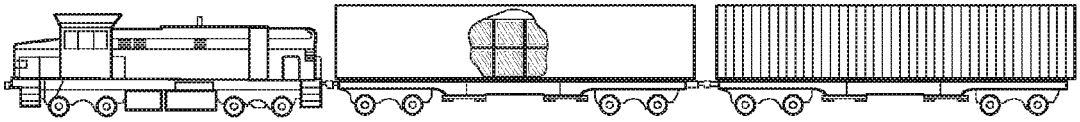
FIG. 12C is a view of the shipment on another mode of transportation.

Referring to FIG. 11B, if desired, the divided manufacturing process described herein may be further and advantageously subdivided to achieve even further unpredicted benefits. For example, the pressurizable container 21 may be manufactured at a first location, and sealed, but not filled with propellant 40. The pressurizable container 21 having no propellant 40 may be transported to a second location.

At the second location, the pressurizable container 21 may be filled with propellant 40. This arrangement provides the benefit that a separate cleaning operation, as is typical in the art after shipping open containers, may be advantageously omitted and obviated.

The now pressurized container may also be filled with product 42 at the second location. Or, if desired, the now pressurized container may be transported to a third location. The pressurized container may be filled with product 42 at such third location. Of course, decorating and other ancillary operations may occur at the first, second, third or later location.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shipment comprising a plurality of pressurized containers, each said pressurized container having a longitudinal axis and being usable for an aerosol dispenser, said shipment being disposed on a truck, train or ship between separate plants, each said pressurized container comprising:

an outer container having an opening therein;

an empty collapsible bag sealed to said outer container, said pressurized container not having and being free of a valve to release product therefrom;

a propellant disposed within said outer container and between said outer container and said collapsible bag, whereby the pressure between said empty bag and said outer container is greater than the pressure inside said empty collapsible bag.

2. A shipment comprising a plurality of pressurized containers according to claim 1, wherein said collaspible bag is polymeric.

3. A shipment comprising a plurality of pressurized containers according to claim 2, further comprising a valve cup joined to said neck of said outer container and being intermediate said outer container and said valve assembly.

4. A shipment comprising a plurality of pressurized containers according to claim 1, wherein said valve cup is polymeric.

5. A shipment according to claim 1, said shipment being disposed on a combination of truck, train and ship between the remote, separate plants.

6. A shipment comprising at least one pressurized container according to claim 2, wherein said polymeric bag comprises PET.

7. A shipment comprising at least one pressurized container according to claim 6, said at least one pressurized container being free of metal.

8. A shipment comprising at least one pressurized container according to claim 6, wherein said outer container and said bag are substantially transparent.

9. A shipment comprising at least one pressurized container according to claim 6, wherein said propellant comprises a Trans-1,3,3,3-tetrafluoroprop-1-ene.

10. A shipment comprising at least one pressurized container according to claim 9, wherein said propellant is condensable, said propellant condensing in response to charging of product into said pressurized container whereby the pressure of said propellant increases due to said charging sufficient to cause said propellant to condense to a liquid state.

11. A shipment comprising at least one pressurized container according to claim 10, wherein said propellant flashes to a gas in response to dispensing of product from said polymeric bag, said propellant being retained within said outer container.

12. A shipment between remote, separate plants, said shipment comprising:

at least one pressurized container, said at least one pressurized container having an outer container having an opening;

a valve assembly joined to said opening of said outer container without a valve cup therebetween, said valve assembly selectively providing a flow path to ambient for a product to be charged into said empty product delivery device;

a bag for containing product therein; said outer container being empty of product while on a truck, train, ship or combination thereof between the remote, separate plants; and a propellant disposed within said outer container, said propellant being at a pressure greater than atmospheric pressure.

13. A shipment according to claim 12, wherein said at least one pressurized container is free of metal.

14. A shipment according to claim 13, wherein said bag further comprises a dip tube therein.

* * * * *